US007059939B2

(12) United States Patent
Lin et al.

(10) Patent No.: US 7,059,939 B2
(45) Date of Patent: Jun. 13, 2006

(54) POLISHING PAD CONDITIONER AND MONITORING METHOD THEREFOR

(75) Inventors: Ching-Long Lin, Kaohsiung (TW); Fu-Tao Ho, Taichung (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 10/932,010

(22) Filed: Sep. 2, 2004

(65) Prior Publication Data

US 2006/0046619 A1 Mar. 2, 2006

(51) Int. Cl.
*B24B 49/00* (2006.01)
*B24B 51/00* (2006.01)

(52) U.S. Cl. ..... 451/21; 451/5; 451/54; 451/285; 15/21.1; 134/32.93

(58) Field of Classification Search ..... 451/5–7, 451/9, 10, 21, 41, 54, 56, 57, 60, 285–290, 451/443, 444; 15/21.1, 39.5, 88.2, 209.1; 134/32, 93

See application file for complete search history.

(56) References Cited

U.S. PATENT DOCUMENTS 5,975,994 A * 11/1999 Sandhu et al. ..... 451/56
6,146,241 A * 11/2000 Lee et al. ..... 451/5
6,306,008 B1 * 10/2001 Moore ..... 451/5
6,524,959 B1 * 2/2003 Lu et al. ..... 438/690
6,695,680 B1 * 2/2004 Choi et al. ..... 451/5
6,699,107 B1 3/2004 Marxsen et al.

* cited by examiner

*Primary Examiner*—Lee D. Wilson
*Assistant Examiner*—Anthony Ojini
(74) *Attorney, Agent, or Firm*—Birch, Stewart, Kolasch & Birch, LLP

(57) ABSTRACT

A polishing pad conditioner for a chemical mechanical polishing apparatus and real-time monitoring method thereof. A conditioning head is supported for rotation at one end of a transverse beam. A drive assembly is coupled to the conditioning head to drive downward force to the conditioning head, and at least one sensor disposed on the transverse beam detects deflection of the transverse beam.

14 Claims, 7 Drawing Sheets

POLISHING PAD CONDITIONER AND MONITORING METHOD THEREFOR

BACKGROUND

The invention relates to a chemical mechanical polishing (CMP) apparatus, and more particularly to a chemical mechanical polishing apparatus with a polishing pad conditioner and a real-time monitoring method therefor.

The manufacture of integrated circuit devices requires the formation of various layers, such as conductor, semiconductor, and insulator layers, on a substrate to form necessary components and interconnects. During the manufacturing process, removal of specific layers or portions thereof must be achieved in order to planarize the various components and interconnects. Chemical mechanical polishing (CMP) is extensively pursued to planarize a surface of a semiconductor substrate, such as a silicon substrate, at various stages of integrated circuit processing. It is also used in polishing optical surfaces, metrology samples, micro-machinery, and various metal and semiconductor based substrates.

The polishing pad of the CMP apparatus requires a uniform and flat surface to provide a desired polishing rate. Over time, however, the polishing process glazes the polishing pad and creates irregularities therein. Accordingly, the polishing pad surface is typically deglazed by a polishing pad conditioner, whereby slurry trapped in the pad pores and surface irregularities is removed and the polishing pad is roughened such that slurry is capable of spreading uniformly thereon.

U.S. Pat. No. 6,699,107, the entirety of which is hereby incorporated by reference, discloses a chemical mechanical polishing apparatus with a polishing pad conditioner. FIG. 1 schematically depicts a conventional chemical mechanical polishing (CMP) apparatus 100. The apparatus 100 comprises a movable platen 101 on which a polishing pad 102 is mounted. A polishing head 110 includes a body 104 and a substrate holder 105 receiving and holding a substrate 103. The polishing head 110 is coupled to a drive assembly 106. Spaced from the polishing head 110 is a polishing pad conditioner 107 having a conditioning head 108. The polishing pad conditioner 107 is coupled to a drive assembly 109. Slurry supply 112 is provided.

A similar conditioner apparatus is disclosed in U.S. Pat. No. 6,695,680 the entirety of which is incorporated herein by reference. The polishing pad conditioner typically comprises a conditioning head having a diamond disk with a roughened surface, a rotary actuating device rotating the conditioning head, and a linear actuating device driving the conditioning head up and down. The conditioning head is moved onto the polishing pad, and the conditioning head rotated against the polishing pad while being forced downward by the actuating devices, thereby conditioning the polishing pad.

It is very important for a CMP apparatus to provide a smooth and controllable polishing rate. In any case, pad conditioning cannot be performed uniformly when the shaft of the conditioner head is jammed by slurry residue or a sealing o-ring is worn. The downward force of the conditioning head is an important processing factor. If downward force of the conditioner head is uneven and unstable, difficulty in controlling thickness and range of the polished layer can result. Unfortunately, instability of thickness of the polished layer caused by the shaft of the conditioning head is detected only after several wafer lots have been polished, thereby decreasing production yield. Moreover, real-time downward force is always not easy to detect, with the sole warning system being thickness of the oxide layer measured after CMP. More specifically, a typical CMP system only maintains the polishing rate in either ex-situ or non-real-time-in-situ pad conditioning, that is, the step of monitoring polishing pad conditioner cannot be simultaneously implemented during CMP.

SUMMARY

Accordingly, the invention provides a chemical mechanical polishing apparatus and a real-time monitoring method therefore with downward force thereof transformed using sensors.

Further provided is a method of monitoring downward force of the conditioning head in real time at a real location during CMP.

A polishing pad conditioner for a chemical mechanical polishing apparatus comprises a transverse beam, a conditioning head comprising an abrasive disk for conditioning a polishing pad, with the conditioning head supported for rotation at one end of the transverse beam, a drive assembly coupled to the conditioning head providing downward force to the conditioning head, and at least one sensor disposed on the transverse beam to detect deflection of the transverse beam.

Also provided is a method of monitoring a polishing pad conditioner, comprising moving a conditioning head in contact with a polishing pad, producing downward force to the conditioning head against the polishing pad, while sensing deflection of a transverse beam, and comparing the value of the deflection of the transverse beam with a corresponding value representative of a normal operation of the polishing pad conditioner.

BRIEF DESCRIPTION OF THE DRAWINGS

The invention can be more fully understood by reading the subsequent detailed description in conjunction with the examples and references made to the accompanying drawings, wherein.

DETAILED DESCRIPTION

Figure 1:
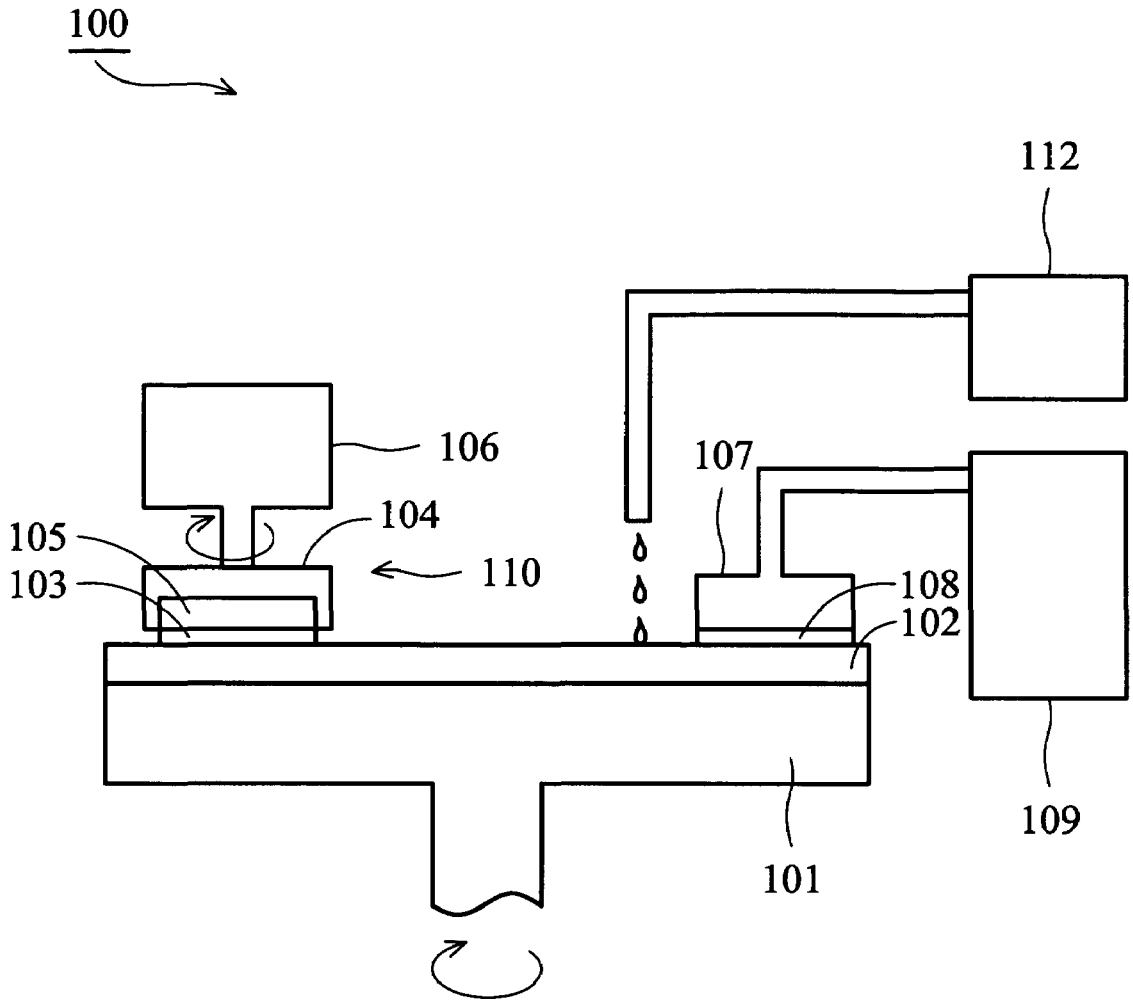
FIG. 1 ( RELATED ART )
FIG. 1 schematically depicts a conventional chemical mechanical polishing (CMP) apparatus.
Figure 2:
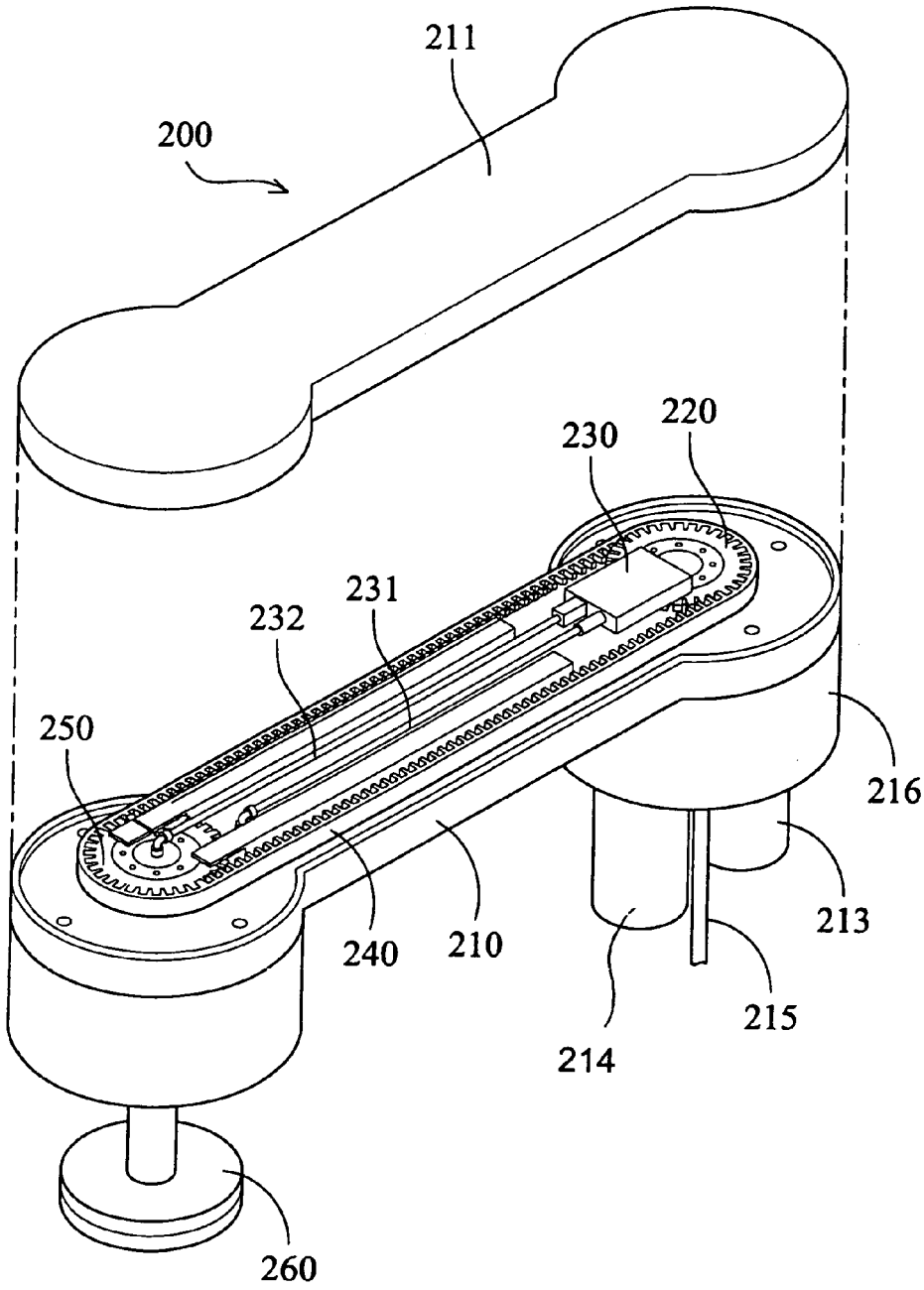
FIG. 2 shows a typical pad conditioner for a CMP apparatus in detail.

FIG. 2 shows a typical pad conditioner 200 for a CMP apparatus in detail, comprising a housing 210 having a first end and a second end, and a cover 211 secured to the housing 210 with bolts. The housing 210 is pivotally connected to the base body (not shown) by means of a shaft disposed at the first end thereof. A lower part of the first end of the housing 210 supports a rotating motor 213 rotating the pad conditioner 200 on the polishing pad and a swing motor 214 oscillating the housing 210 between the base and the polishing pad. An air supply tube 215 is externally connected to the first end of the housing 210.

A gear box 216 (not shown) is provided over the rotating motor 213 and the swing motor 214 to transmit driving forces supplied by motors 213 and 214. A first pulley 220 rotated by a rotating motor 213 and an air pressure controller 230 are disposed in an upper part of the first end of the housing 210. A second pulley 250 is disposed in the second end of the housing 210. A timing belt 240 engages the first pulley 220 and the second pulley 250, so that the timing belt 240 is driven in association with the rotation of the first pulley 220 to transfer rotary drive force to the second pulley 250.

An air supply tube 232 and an air recovery tube 231 are connected to the air pressure controller 230 and extend longitudinally along the upper part of the housing 210 between the first and second ends thereof. Furthermore, the air supply tube 232 extends into a hole formed through the second end of the housing 210 at the center portion thereof.

A conditioning head 260 having a diamond abrasive disk is mounted on the bottom of the second end of the housing 210 and is rotatably connected thereto by means of a shaft.

Figure 3:
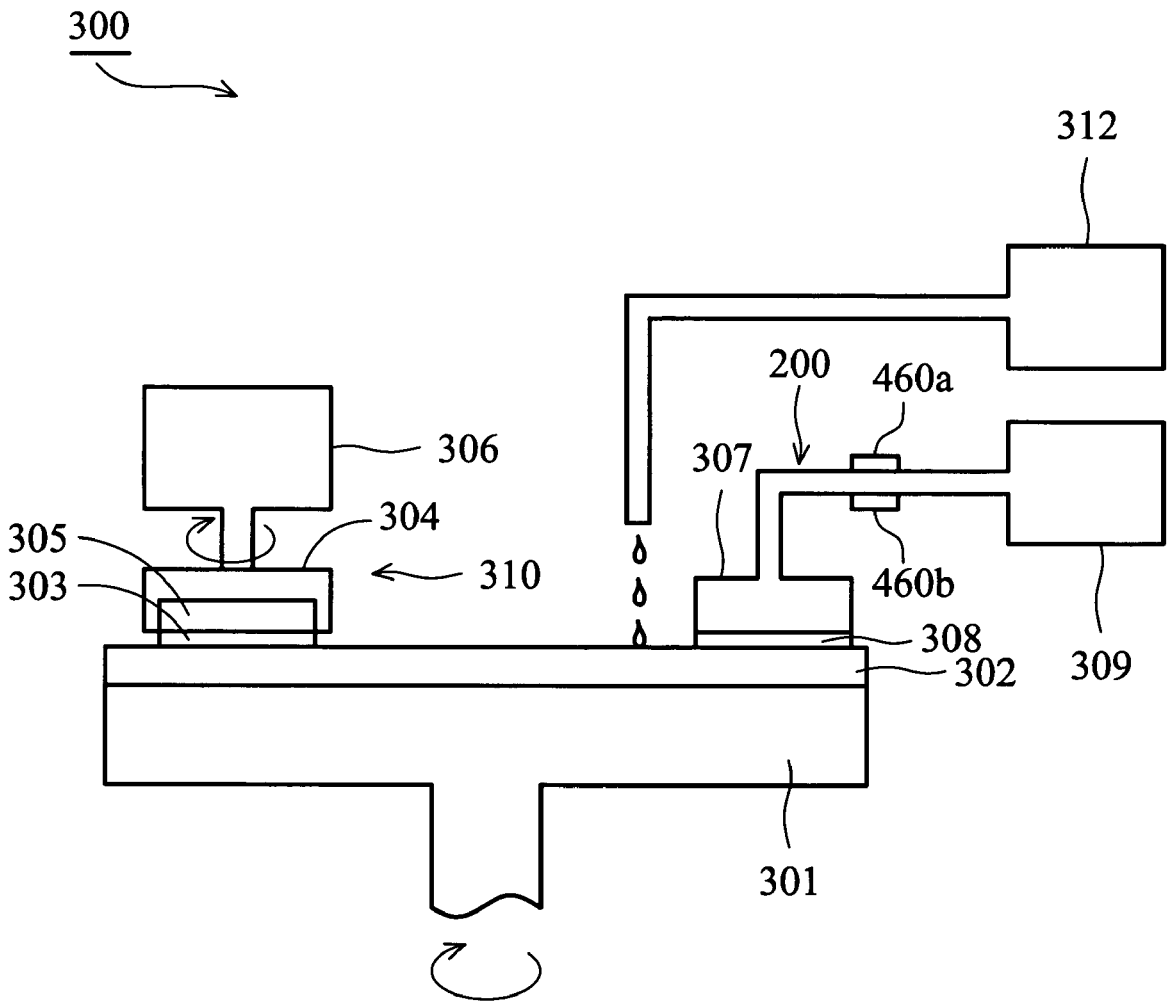
FIG. 3 schematically depicts a chemical mechanical polishing (CMP) apparatus according to an embodiment of the invention.

FIG. 3 schematically depicts a chemical mechanical polishing (CMP) apparatus 300 according to an embodiment of the invention. The apparatus 300 comprises a movable platen 301 on which a polishing pad 302 is mounted. A polishing head 310 includes a body 304 and a substrate holder 305 receiving and holding a substrate 303. The polishing head 310 is coupled to a drive assembly 306. Spaced from the polishing head 310 is a polishing pad conditioner 307 having a conditioning head 308. A drive assembly 309 is coupled to the polishing pad conditioner 307 to provide downward force to the conditioning head 308, with two sensors, such as strain gauge 460*a* and 460*b* disposed on the upper and lower surfaces of the transverse beam to detect deflection of the transverse beam 00. Slurry supply 112 is provided.

Figure 4A:
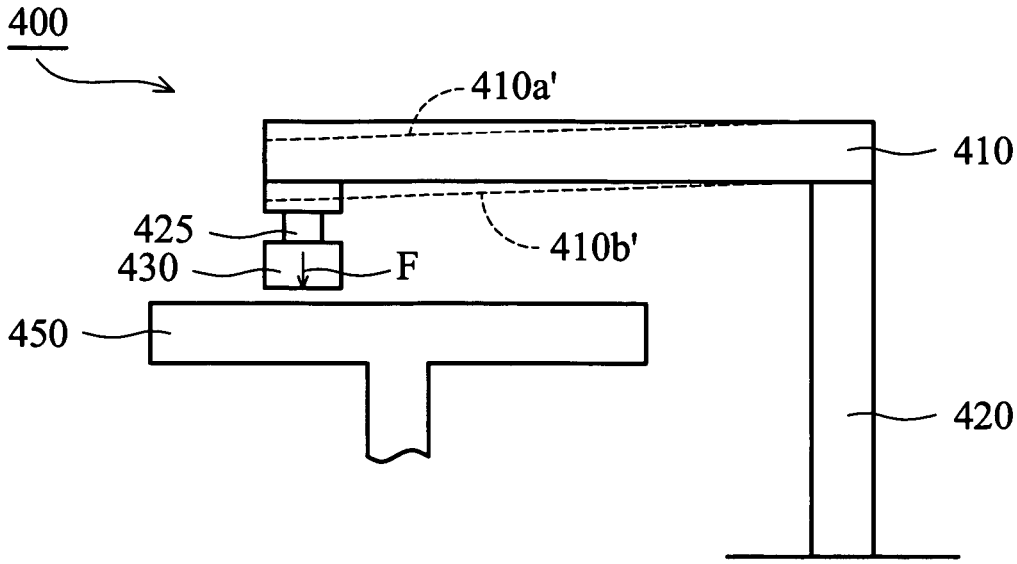
FIGS. 4A and 4B illustrate simplified structures of the polishing pad conditioner according to an embodiment of the invention.
Figure 4B:
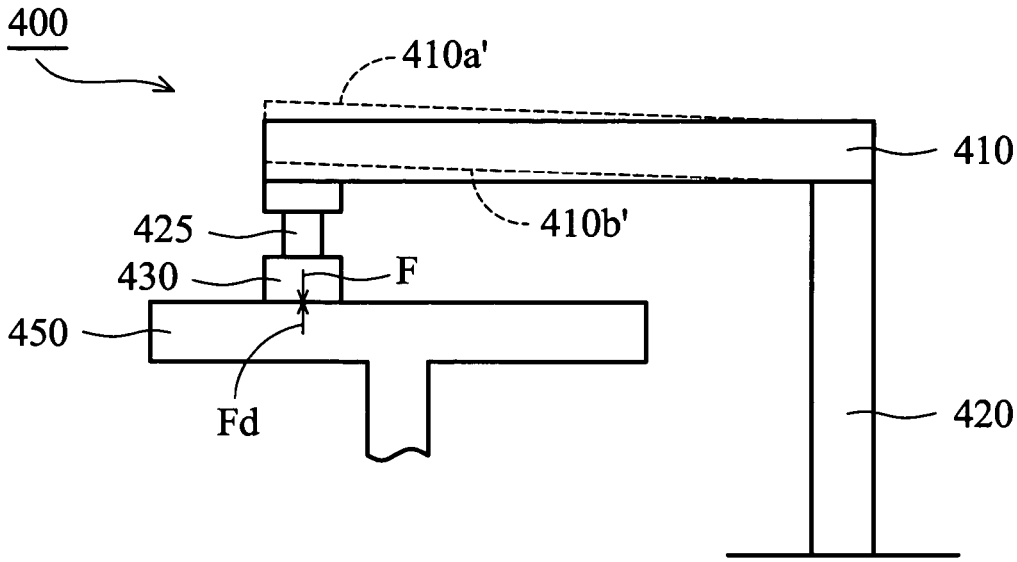

FIGS. 4A and 4B illustrate simplified structures of the polishing pad conditioner according to an embodiment of the invention. In FIG. 4A, a chemical mechanical polishing apparatus 400 comprises a transverse beam 410, a conditioning head 430 comprising an abrasive disk conditioning a polishing pad 450, wherein the conditioning head 430 is supported for rotation at one end of the transverse beam 410 and is rotatably connected thereto by means of a shaft 425. The fixed end 420 of the transverse beam 410 is supported for sweep rotation. A drive assembly 309 (shown in FIG. 3) is coupled to the conditioning head 430 to drive downward force to the conditioning head 430.

The transverse beam bears only the load of the conditioning head F, for example, 5–11 lb. The upper surface 410*a*' of the transverse beam 410 is tensile, while the lower surface 410*b*' of the transverse beam 410 is compressed. As downward force is provided to the conditioning head 430, a counter force Fd is exerted against the conditioning head 430. The upper surface 410*a*' of the transverse beam 430 can be compressed, while the lower surface 410*b*' of the transverse beam 410 can be tensile, as shown in FIG. 4B.

Figure 4C:
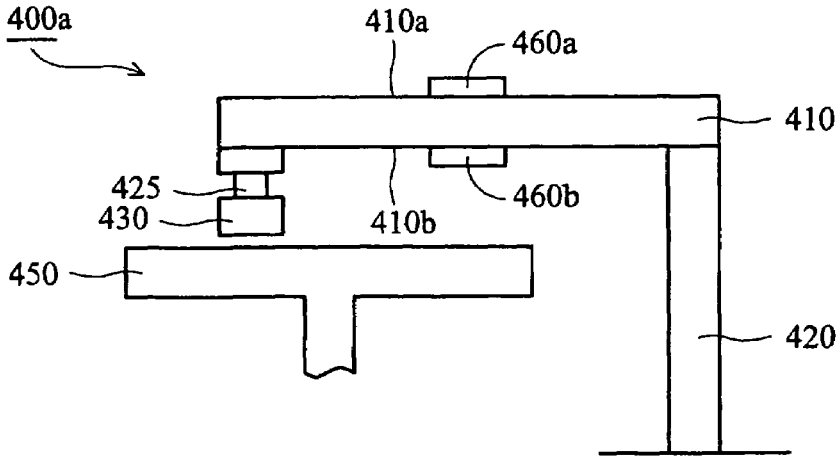
FIG. 4C shows two strain gauges disposed on the upper and lower surface of the transverse beam according to an embodiment of the invention.
Figure 4D:
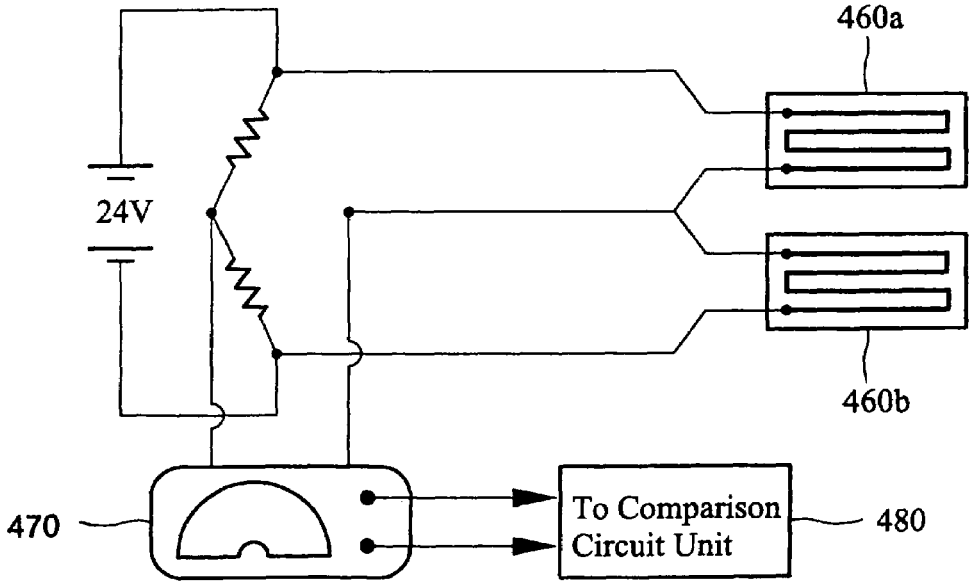
FIG. 4D shows a Wheatstone bridge circuit according to an embodiment of the invention.

Deflection of the transverse beam is measured by at least one sensor, preferably a strain gauge. Alternatively, deflection of the transverse beam can also be measured by an optical device, such as photodetector. FIG. 4C shows two strain gauges disposed on the upper and lower surface of the transverse beam. In FIG. 4C, a chemical mechanical polishing apparatus 400*a* comprises a transverse beam 410, a conditioning head 430 comprising an abrasive disk conditioning a polishing pad 450, wherein the conditioning head 430 is supported for rotation at one end of the transverse beam 410 and is rotatably connected thereto by means of a shaft 425. The fixed end 420 of the transverse beam 410 is supported for sweep rotation. A drive assembly 309 (shown in FIG. 3) is coupled to the conditioning head 410 to drive downward force to the polishing pad 450, and two sensors, such as strain gauges 460*a* and 460*b* are disposed on the upper and lower surfaces of the transverse beam 410 to detect deflection of the transverse beam 410. The strain gauges 460*a* and 460*b* can be electrically coupled to a Wheatstone bridge circuit, as shown in FIG. 4D. It is commonly known that the strain gauge converts applied strain to a proportional change of resistance. A Wheatstone bridge is also suited for measurement of small changes in resistance and, therefore, is also suitable for measurement of resistance change in the strain gauge. The output of the Wheatstone bridge circuit is provided to a transducer 470 which provides a signal to a comparison circuit unit 480.

Figure 4E:
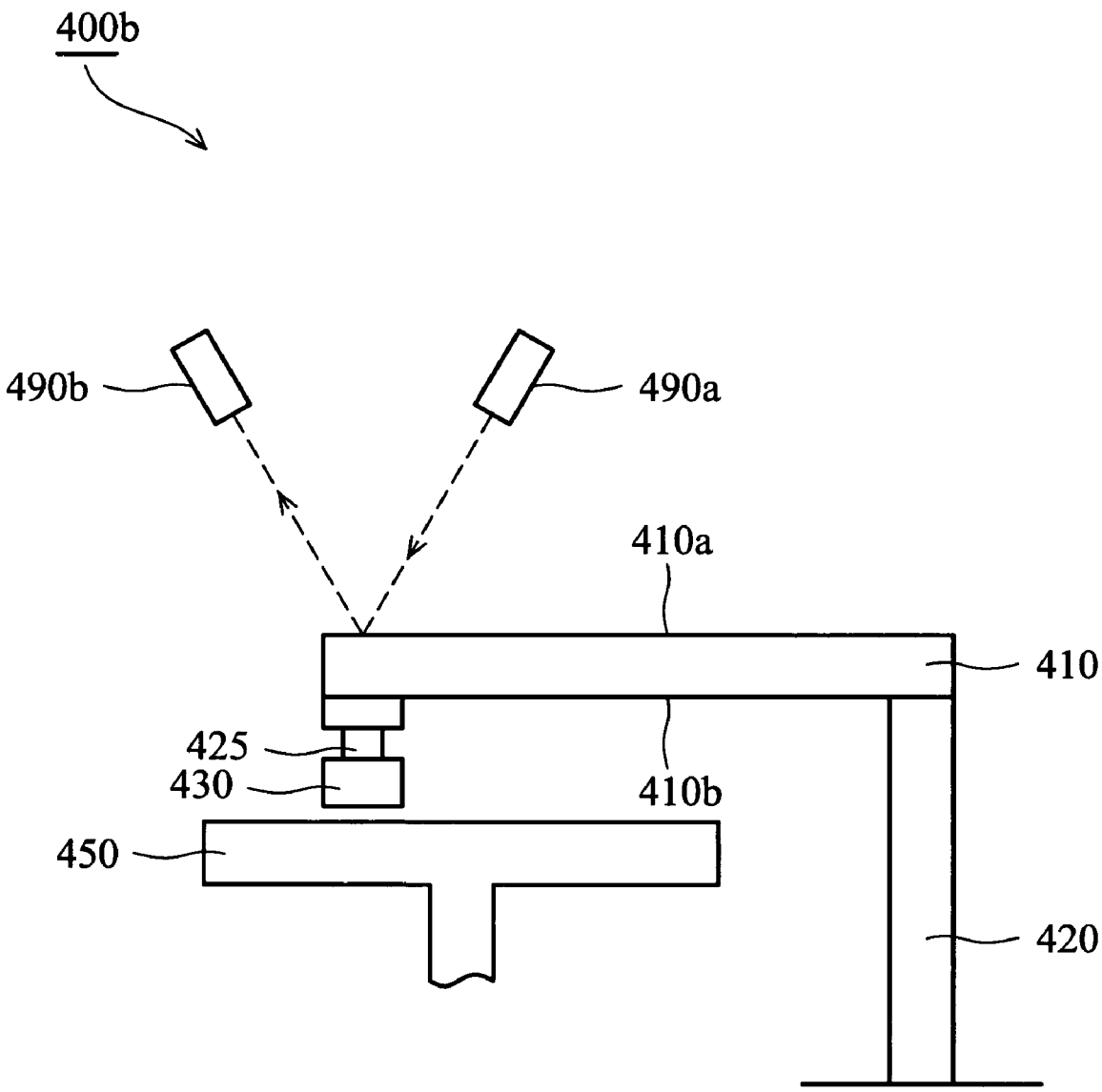
FIG. 4E shows a method of measuring deflection of the transverse beam using optical device according to an embodiment of the invention.

FIG. 4E shows another method of measuring deflection of the transverse beam using optical technique. A chemical mechanical polishing apparatus 400*b* comprises a transverse beam 410, a conditioning head 430 comprising an abrasive disk conditioning a polishing pad 450, wherein the conditioning head 430 is supported for rotation at one end of the transverse beam 410. A drive assembly is coupled to the conditioning head to drive downward force to the conditioning head. A laser source 490*a* creates a laser beam reflect from the transverse beam 410 to a laser detector 490*b*. Consequently, deflection of the transverse beam can thus be detected. Laser beam deflection offers a convenient and accurate method of measuring deflection of transverse beam.

Figure 5:
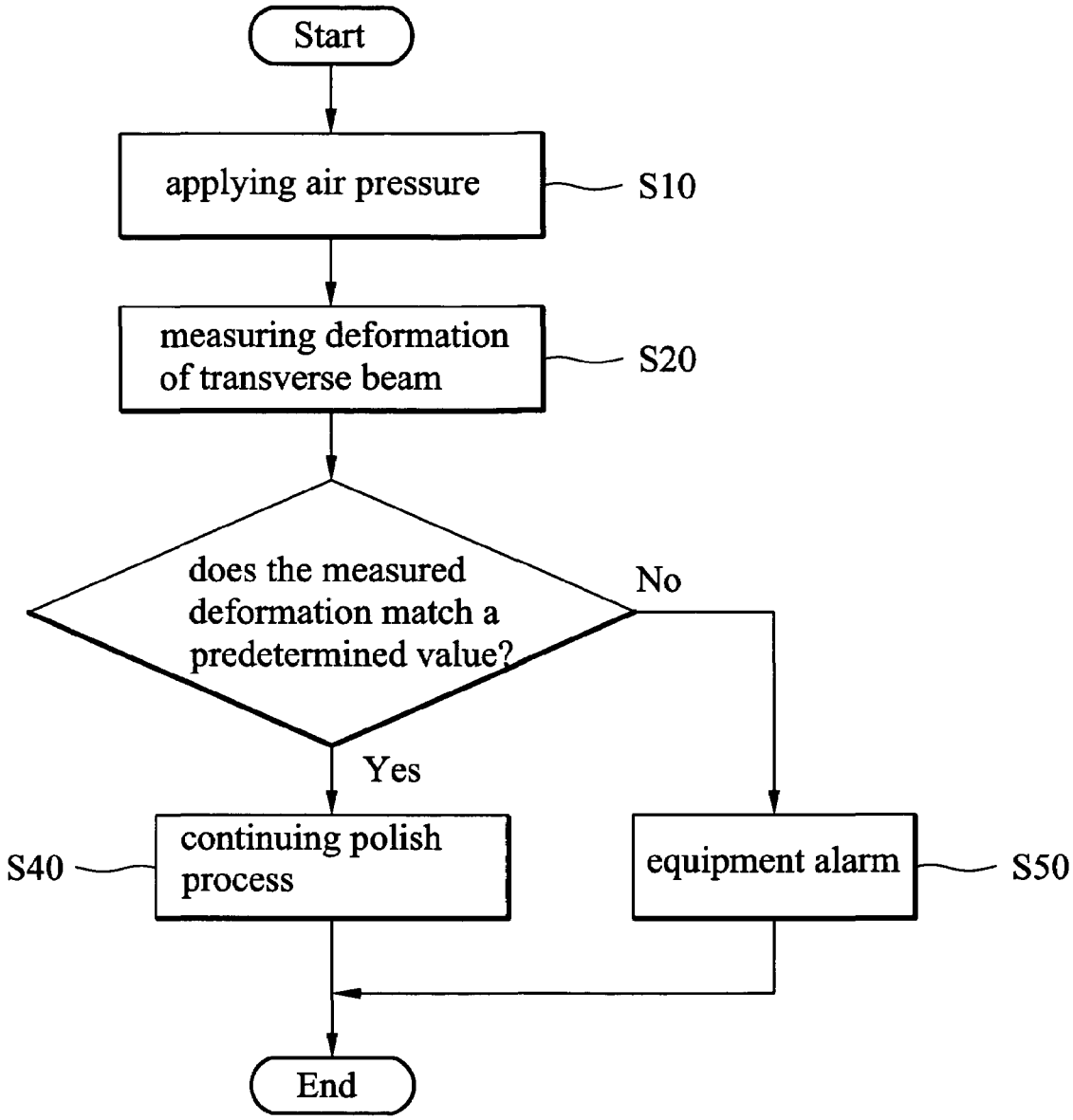
FIG. 5 is a flow diagram showing operation of the polishing pad conditioner according to an embodiment of the invention.

FIG. 5 is a flow diagram showing operation of the polishing-pad conditioner according to an embodiment of the invention. In FIG. 5, the strain gauges 460*a* and 460*b* test whether the deflection of the transverse beam 410 is normal. A conditioning head 430 is moved in contact with a polishing pad 450, as air pressure is applied to the conditioning head 430 through the external air supply tube (S10). Once a certain level of pressure is produced, the abrasive disk of the conditioning head 430 is driven downward to contact the polishing pad 450, while the conditioning head 430 is forced against the polishing pad 450. Deflection of the transverse beam 420 is measured using strain gauges 460*a* and 460*b* (S20).

The value of the deformation of the transverse beam 420 is compared with a predetermined deformation value (S30) using a comparison circuit unit 480. Where differences occur, the CMP apparatus is inter-locked (S50) and the CMP process stopped by the presence of abnormal operation, whereby appropriate actions are taken to obviate the problem or problems causing the abnormal operation.

Abnormality detection indicates that the shaft of the conditioner head is jammed by slurry and/or the O-ring is worn out or torn. In fact, most cases of abnormal operation due to low or unstable down force are the result of a jammed shaft. In this case, primary maintenance and cleaning of the shaft of the conditioner head are required.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A polishing pad conditioner for a chemical mechanical polishing apparatus, comprising:

a transverse beam;

a conditioning head comprising an abrasive disk for conditioning a polishing pad, the conditioning head supported at one end of the transverse beam;

a drive assembly coupled to the conditioning head to drive downward force to the conditioning head; and two strain gauges disposed on the top and bottom surfaces of the transverse beam, detecting deflection of the transverse beam;

wherein the two strain gauges are composed of a Wheatstone bridge circuit.

2. The polishing pad conditioner as claimed in claim 1, wherein the weight of the conditioning head is approximately 5–11 pounds.

3. The polishing pad conditioner as claimed in claim 1, wherein the abrasive disk is a diamond head.

4. The polishing pad conditioner as claimed in claim 1, wherein the downward force of the conditioner head is driven by air pressure.

5. A polishing pad conditioner for a chemical mechanical polishing apparatus, comprising:

a transverse beam, a conditioning head comprising an abrasive disk for conditioning a polishing pad, the conditioning head supported at one end of the transverse beam:

a drive assembly coupled to the conditioning head to drive downward force to the conditioning head; and an optical sensor detecting deflection of the transverse beam.

6. A chemical mechanical polishing apparatus, comprising:

a polishing pad;

a carrier to hold a workpiece in contact with a surface of the polishing pad;

a polishing pad conditioner for conditioning the polishing pad comprising:

a transverse beam;

a conditioning head having an abrasive disk for conditioning the polishing pad, with the conditioning head supported at one end of the transverse beam;

a drive assembly coupled to the conditioning head to drive downward force to the conditioning head; and two strain gauges disposed on the top and bottom surfaces of the transverse beam to sense deflection of the transverse beam; wherein the two strain gauges are composed of a Wheatstone bridge circuit; and a comparison means comparing the measured deformation to a predetermined deflection.

7. The chemical mechanical polishing apparatus as claimed in claim 6, wherein the weight of the conditioning head is approximately 5–11 pounds.

8. The chemical mechanical polishing apparatus as claimed in claim 6, wherein the abrasive disk is a diamond head.

9. The chemical mechanical polishing apparatus as claimed in claim 6, wherein the downward force of the conditioning head is driven by air pressure.

10. The chemical mechanical polishing apparatus as claimed in claim 6, wherein deflection of the transverse beam is measured by an optical sensor.

11. A method of monitoring the operation of a polishing pad conditioner, comprising:

moving a conditioning head into contact with a polishing pad;

producing downward force to the conditioning head against the polishing pad, while detecting deflection of a transverse beam by two strain gauges disposed on the top and bottom of the transverse beam; wherein the two strain gauges are composed of a Wheatstone bridge circuit; and comparing the value of the deflection of the transverse beam with a corresponding value representative of normal operation of the polishing pad conditioner.

12. The method as claimed in claim 11, wherein the weight of the conditioning head is approximately 5–11 pounds.

13. The method as claimed in claim 11, wherein the downward force of the conditioning head is driven by air pressure.

14. The method as claimed in claim 11, wherein deflection of the transverse beam is measured by an optical sensor.

* * * * *